US011795738B2

(12) United States Patent
Ney

(10) Patent No.: US 11,795,738 B2
(45) Date of Patent: Oct. 24, 2023

(54) SERVICE OVERRIDE FOR ELECTRIC RELEASE LATCHING SYSTEM

(71) Applicant: Inteva Products, LLC, Troy, MI (US)

(72) Inventor: Daniel Alexander Ney, Lake Orion, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 56 days.

(21) Appl. No.: 16/852,445

(22) Filed: Apr. 18, 2020

(65) Prior Publication Data

US 2020/0332574 A1 Oct. 22, 2020

Related U.S. Application Data

(60) Provisional application No. 62/836,406, filed on Apr. 19, 2019.

(51) Int. Cl.

| | |
|---|---|
| ***E05B 81/90*** | (2014.01) |
| ***E05B 81/42*** | (2014.01) |
| ***E05B 81/34*** | (2014.01) |

(52) U.S. Cl.

CPC ..... *E05B 81/90* (2013.01); *E05B 81/34* (2013.01); *E05B 81/42* (2013.01)

(58) Field of Classification Search

CPC ..... E05B 81/34; E05B 81/42; E05B 81/90; E05B 83/26; E05B 81/20

USPC ..... 292/195

See application file for complete search history.

(56) References Cited

U.S. PATENT DOCUMENTS

| | | | | |
|---|---|---|---|---|
| 5,632,515 | A * | 5/1997 | Dowling | E05B 81/14 292/216 |
| 5,642,636 | A * | 7/1997 | Mitsui | E05B 17/0062 292/201 |
| 6,419,286 | B1 * | 7/2002 | Szablewski | E05B 81/14 292/216 |
| 8,522,583 | B2 * | 9/2013 | Cumbo | E05B 81/36 70/279.1 |
| 10,472,869 | B2 * | 11/2019 | Fannon | E05B 81/14 |
| 11,072,949 | B2 * | 7/2021 | Strole | E05B 81/20 |

(Continued)

FOREIGN PATENT DOCUMENTS

| | | |
|---|---|---|
| WO | 2006015481 A1 | 2/2006 |
| WO | 2014032641 A2 | 3/2014 |
| WO | 2019068277 A1 | 4/2019 |

OTHER PUBLICATIONS

International Preliminary Report on Patentability; International Application No. PCT/US2020/028883; International Filing Date; Apr. 18, 2020; dated Sep. 28, 2021; 5 Pages.

(Continued)

*Primary Examiner* — Kristina R Fulton
*Assistant Examiner* — James Edward Ignaczewski
(74) *Attorney, Agent, or Firm* — CANTOR COLBURN LLP

(57) ABSTRACT

A power release latching system with a service reset. A power release latching system, including: a housing; a service override lever rotatably mounted to the housing, the service override lever being accessible from an exterior of the housing; a motor for rotating a worm that interfaces to a release gear, the release gear having a cam profile that interfaces with a pawl release lever of the latching system, wherein rotation of the service override lever causes rotation of the release gear.

15 Claims, 11 Drawing Sheets

(56) References Cited

U.S. PATENT DOCUMENTS

| | | | | |
|---|---|---|---|---|
| 2007/0126244 | A1* | 6/2007 | Ilea | E05B 81/14 292/201 |
| 2013/0270840 | A1* | 10/2013 | Lujan | E05B 83/18 292/100 |
| 2017/0191289 | A1 | 7/2017 | Perkins | |
| 2018/0163439 | A1 | 6/2018 | Patane et al. | |

OTHER PUBLICATIONS

International Search Report; International Application No. PCT/US2020/028883; International Filing Date Apr. 18, 2020; dated Jun. 25, 2020; 3 Pages.

Notification Concerning Transmittal of International Preliminary Report on Patentability; International Application No. PCT/US2020/028883; International Filing Date Apr. 18, 2020; dated Oct. 28, 2021; 1 Page.

Written Opinion; International Application No. PCT/US2020/028883; International Filing Date Apr. 18, 2020; dated Jun. 25, 2020; 4 Pages.

Supplementary European Search Report dated Dec. 6, 2022; EP Application No. EP20791907; 9 pages.

* cited by examiner

Figure 7A
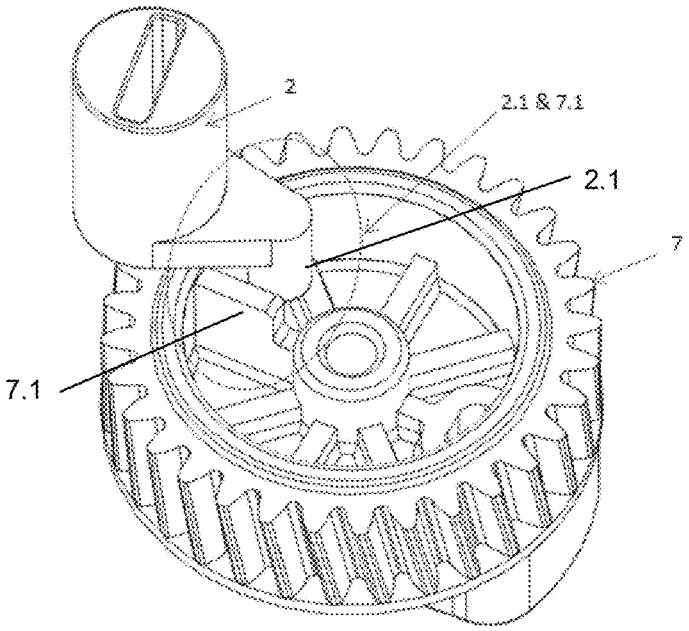
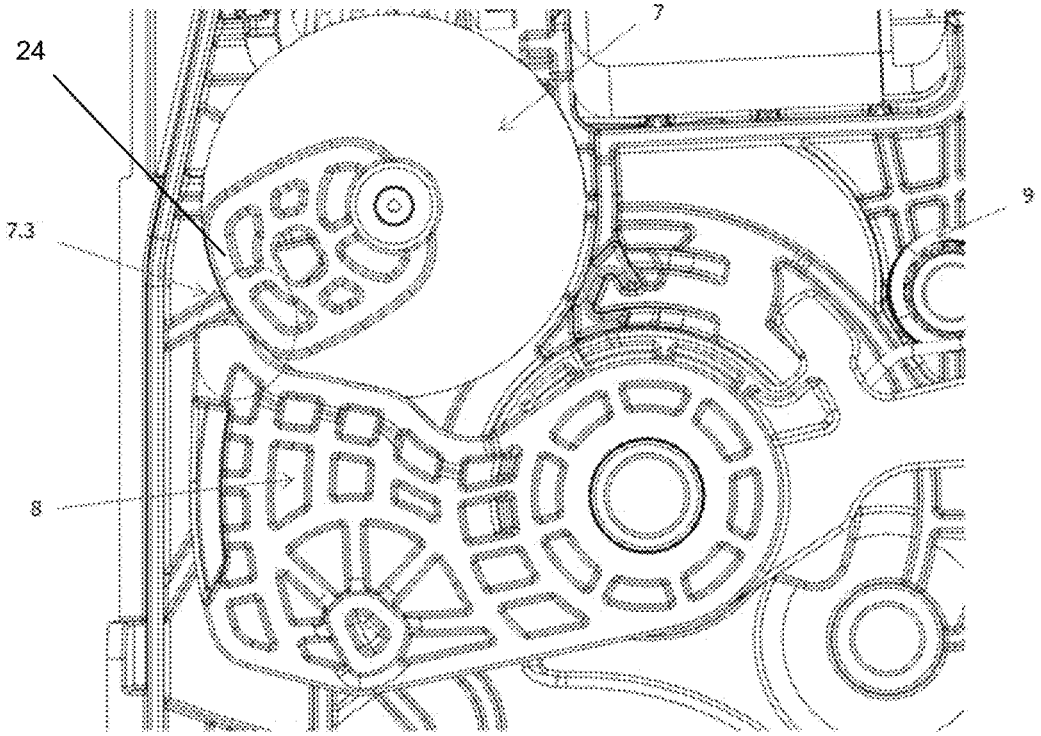
Figure 7B

Figure 8A
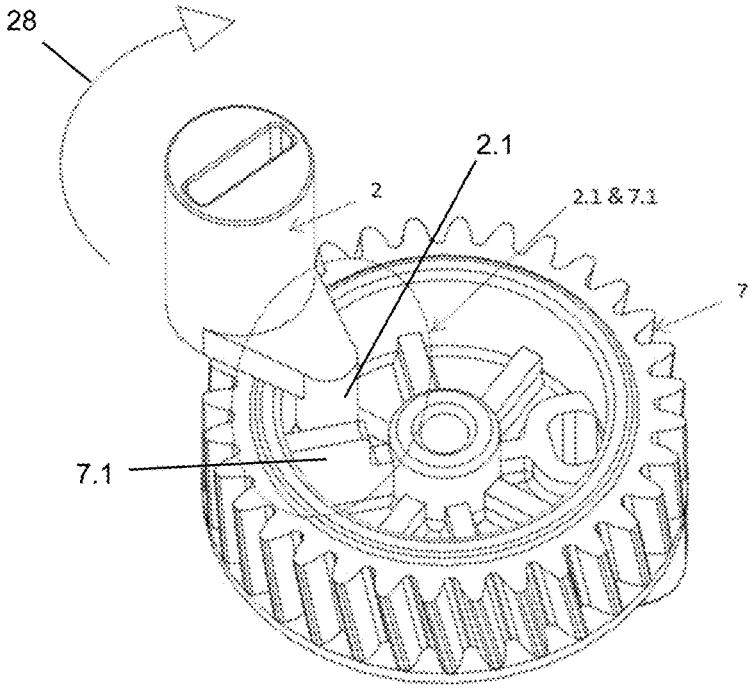
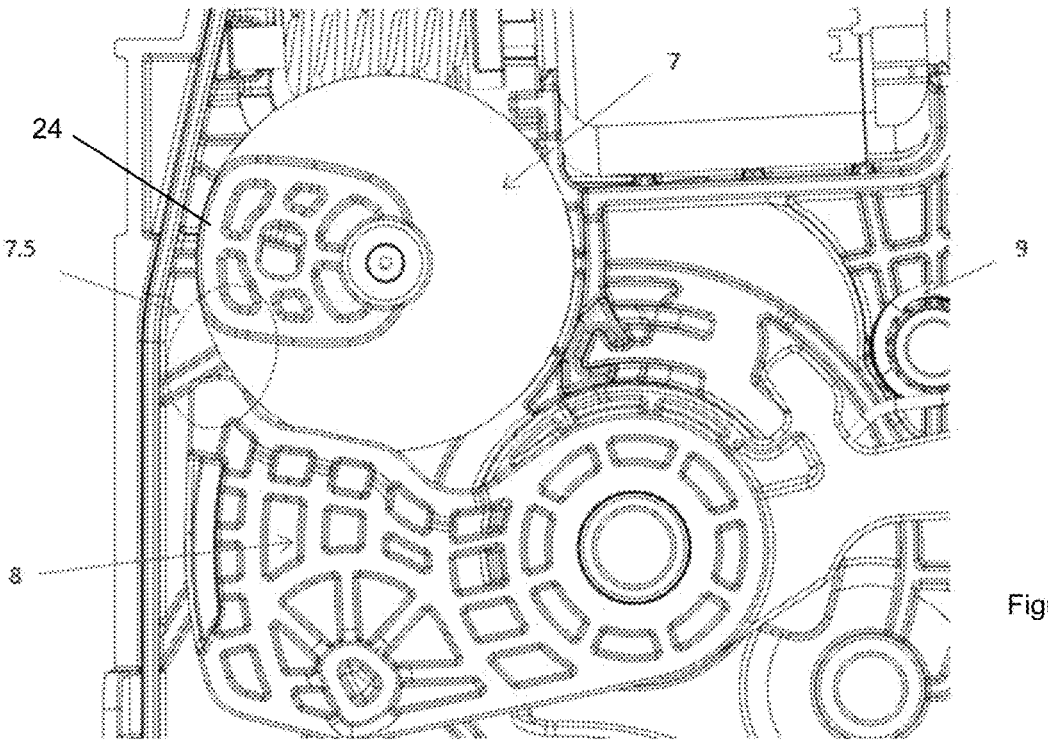
Figure 8B

SERVICE OVERRIDE FOR ELECTRIC RELEASE LATCHING SYSTEM

CROSS REFERENCE TO RELATED APPLICATIONS

This application claims priority to the following U.S. Provisional Patent Application, Ser. No. 62/836,406 filed on Apr. 19, 2019 the contents of which are incorporated herein by reference thereto.

BACKGROUND

Exemplary embodiments of the present disclosure pertain to power release latching systems.

In power release latching systems, it is critical that the release actuator must be able to advance to release to latch by lifting or moving the pawl, and then return home, to allow for the pawl to return to a latching condition. However, during the release event, once the actuator has advanced and the pawl has been lifted or moved, it must hold it there for a specified amount of time. Since the pawl's release lever has a spring that biases it towards the closed position, it is capable of back driving the gear when the motor is not energized during a release event. The two options for holding the pawl open are too keep the motor energized, or to create a locking condition between the motor's gear train, and the pawl's release lever, when at full travel. When using the energizing method, an operator may hear additional noise in the system, as well as use or pull more power from the car's battery. The problem with creating the locking condition is that if there is a failure in the motor during a release event, and it gets stuck at full travel, then the pawl will not return home, and the user's door will not be able to close.

BRIEF DESCRIPTION

Disclosed herein is a power release latching system with a service reset.

Disclosed is a power release latching system, including: a housing; a service override lever rotatably mounted to the housing, the service override lever being accessible from an exterior of the housing; a motor for rotating a worm that interfaces to a release gear, the release gear having a cam profile that interfaces with a pawl release lever of the latching system, wherein rotation of the service override lever causes rotation of the release gear.

In addition to one or more of the features described above, or as an alternative to any of the foregoing embodiments, the service override lever has a boss that is configured to contact a wall of the release gear.

In addition to one or more of the features described above, or as an alternative to any of the foregoing embodiments, the boss is spaced from the wall when the release gear is in a home position.

In addition to one or more of the features described above, or as an alternative to any of the foregoing embodiments, the boss contacts the wall when the release gear is in a full travel position.

In addition to one or more of the features described above, or as an alternative to any of the foregoing embodiments, the cam profile contacts the pawl release lever when the release gear is in the full travel position.

In addition to one or more of the features described above, or as an alternative to any of the foregoing embodiments, the cam profile contacts the pawl release lever when the release gear is in a full travel position.

In addition to one or more of the features described above, or as an alternative to any of the foregoing embodiments, the service override lever has a tab with a boss that is configured to contact a wall of the release gear.

In addition to one or more of the features described above, or as an alternative to any of the foregoing embodiments, the boss is spaced from the wall when the release gear is in a home position.

In addition to one or more of the features described above, or as an alternative to any of the foregoing embodiments, the boss contacts the wall when the release gear is in a full travel position.

In addition to one or more of the features described above, or as an alternative to any of the foregoing embodiments, further including a return spring for biasing the pawl release lever about a pivot.

In addition to one or more of the features described above, or as an alternative to any of the foregoing embodiments, further including a frame configured to mount the latch system to a vehicle sheet metal.

In addition to one or more of the features described above, or as an alternative to any of the foregoing embodiments, the pawl release lever is operably coupled to a pawl that interfaces with a claw of the latch system.

In addition to one or more of the features described above, or as an alternative to any of the foregoing embodiments, the service override lever has a boss that is configured to contact a wall of the release gear.

In addition to one or more of the features described above, or as an alternative to any of the foregoing embodiments, the boss is spaced from the wall when the release gear is in a home position and wherein the boss contacts the wall when the release gear is in a full travel position.

In addition to one or more of the features described above, or as an alternative to any of the foregoing embodiments, the cam profile contacts the pawl release lever when the release gear is in the full travel position.

In addition to one or more of the features described above, or as an alternative to any of the foregoing embodiments, further including a return spring for biasing the pawl release lever about a pivot.

Also disclosed is a method for manually releasing a power release latching system, including: rotatably mounting a service override lever to a housing of the latching system, the service override lever being accessible from an exterior of the housing; and rotating a release gear of the latching system with the service override lever, the release gear having a cam profile that interfaces with a pawl release lever of the latching system.

In addition to one or more of the features described above, or as an alternative to any of the foregoing embodiments, the pawl release lever is operably coupled to a pawl that interfaces with a claw of the latch system.

In addition to one or more of the features described above, or as an alternative to any of the foregoing embodiments, the service override lever has a boss that is configured to contact a wall of the release gear.

In addition to one or more of the features described above, or as an alternative to any of the foregoing embodiments, the boss is spaced from the wall when the release gear is in a home position and wherein the boss contacts the wall when the release gear is in a full travel position.

BRIEF DESCRIPTION OF THE DRAWINGS

The following descriptions should not be considered limiting in any way. With reference to the accompanying drawings, like elements are numbered alike:

The attached FIGS. illustrate various view of a power release latching system with a service reset as disclosed herein.

FIGS. 7A and 7B illustrate the release gear at a full travel position;

FIGS. 8A and 8B illustrate a service override lever of the latch assembly being actuated in order to start back driving the release gear;

DETAILED DESCRIPTION

A detailed description of one or more embodiments of the disclosed apparatus and method are presented herein by way of exemplification and not limitation with reference to the Figures.

The present disclosure allows for a service reset of a power release system by the user. This feature is achieved by an additional lever that interfaces to the power release gear. The gear and pawl release lever's cam interface is designed so that the pawl release lever has the ability to backdrive the gear for approximately the first 90-95% of travel, and at the end of travel creates the locking condition where the force vector of the pawl release lever acting on the gear is driving close the gears pivot, therefore not creating a torque capable of driving the motor. This additional lever would be interfaced to release gear and would be capable of rotating the gear the end of travel position, and just past the locking condition, so that the return spring on the pawl release lever will create a large enough torque to reset the gear. (e.g., if the gear is stuck at end of travel, the user will manually rotate the additional lever, which will backdrive the gear 10-25% of its total travel. Therefore, allowing the pawl release lever to drive it back the remaining travel to home position.)

A hole or slot in the sheet metal of the door or vehicle door would be provided to allow for the user to access and actuate this lever using a key, tool or screwdriver etc. Once the user rotates this lever, and the gear returns home, the pawl can return home, and the door may be closed safely.

The primary function of this concept is to be able to reset the release system after motor failure, without having to completely service the latch, or remove trim panels, etc. from the door. With this, if the latch were to fail, then the door would not close. This allows for the driver to be able to close their door until they are able to get the latch serviced. If this option was not available, then the person would have to leave their door wide open until they can get to a dealer, and also would not be able to drive their car to the dealer, because the door would not close.

Figure 1:
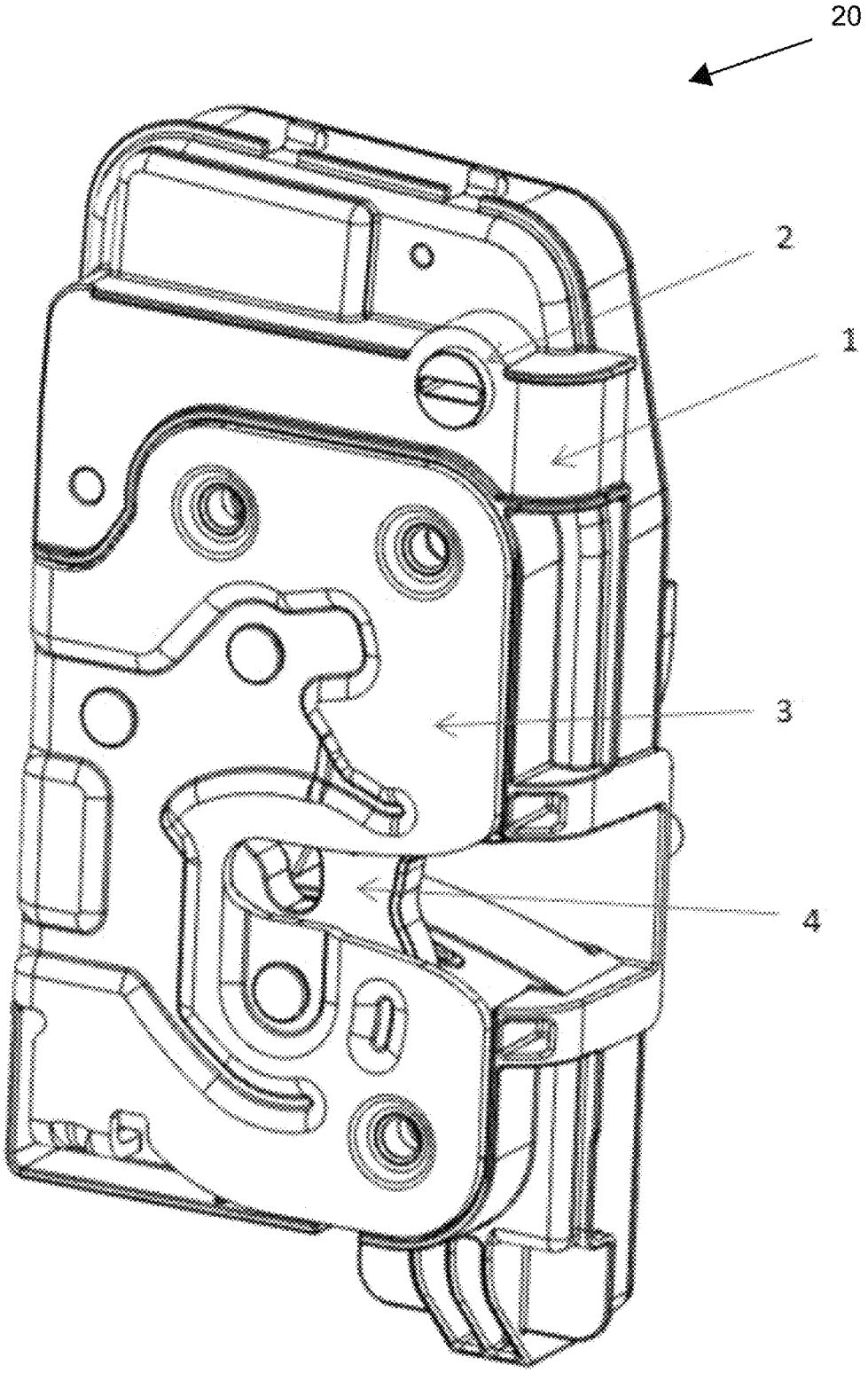
FIGS. 1 and 2 are perspective views of a latch assembly with one location of a service override lever in accordance with the present disclosure.

FIG. 1 shows a latch assembly 20 with one of the possible locations for a service override lever 2 this is rotatably mounted to the latch assembly 20. The latch assembly 20 in this view shows the housing 1, the frame 3, which mounts the latch to the vehicle sheet metal, and the claw 4, which retains the door closed to vehicle by latching onto a striker (not shown). The service override lever 2 in this concept is designed to align with a hole in the sheet metal where a key or tool (e.g., screwdriver) can come through and rotate it. As illustrated, the service override lever 2 is rotatably mounted to the latch assembly 20 and is accessible from an exterior of the housing 1.

Figure 2:
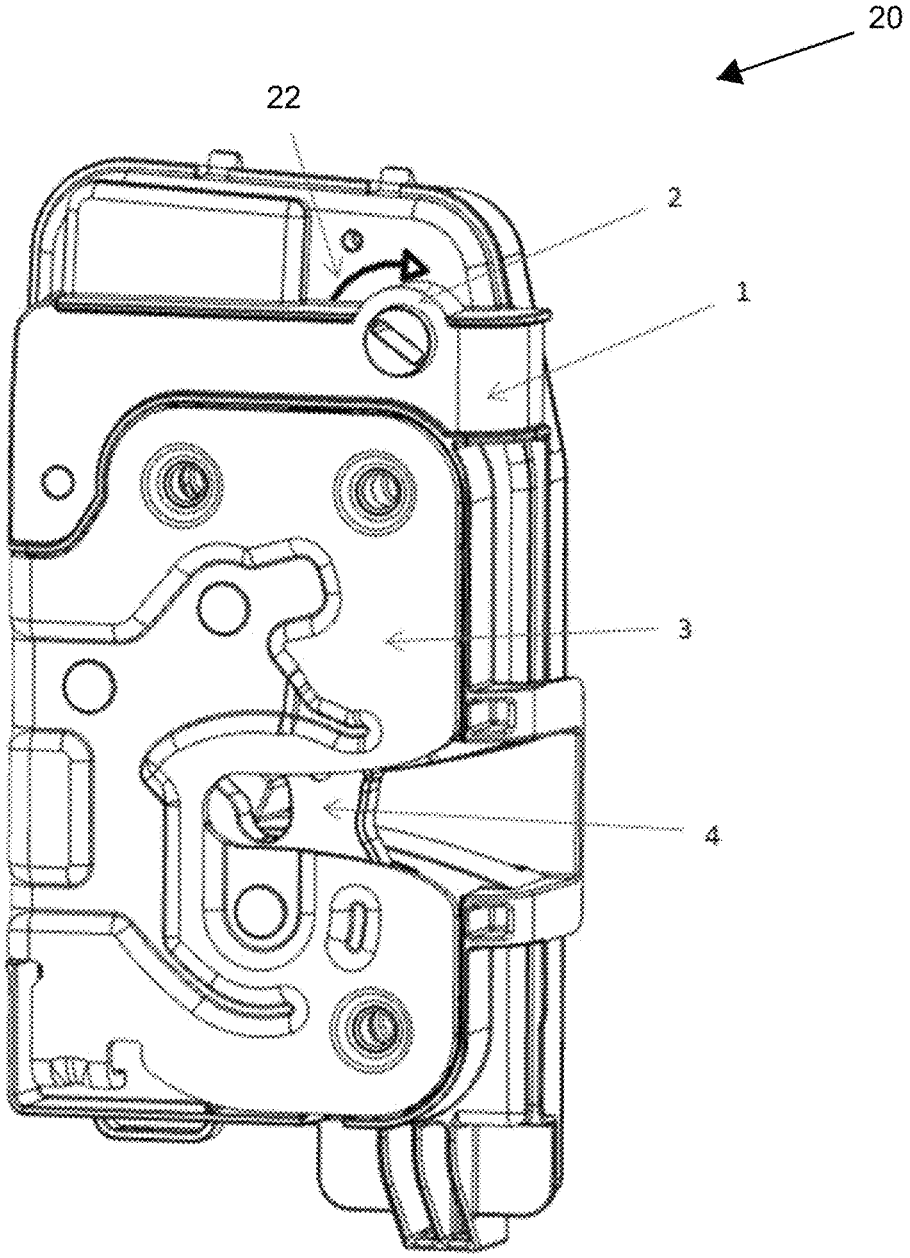

FIG. 2 again shows the latch assembly along with the direction of rotation (arrow 22) for the service override lever 2 in this design.

Figure 3:
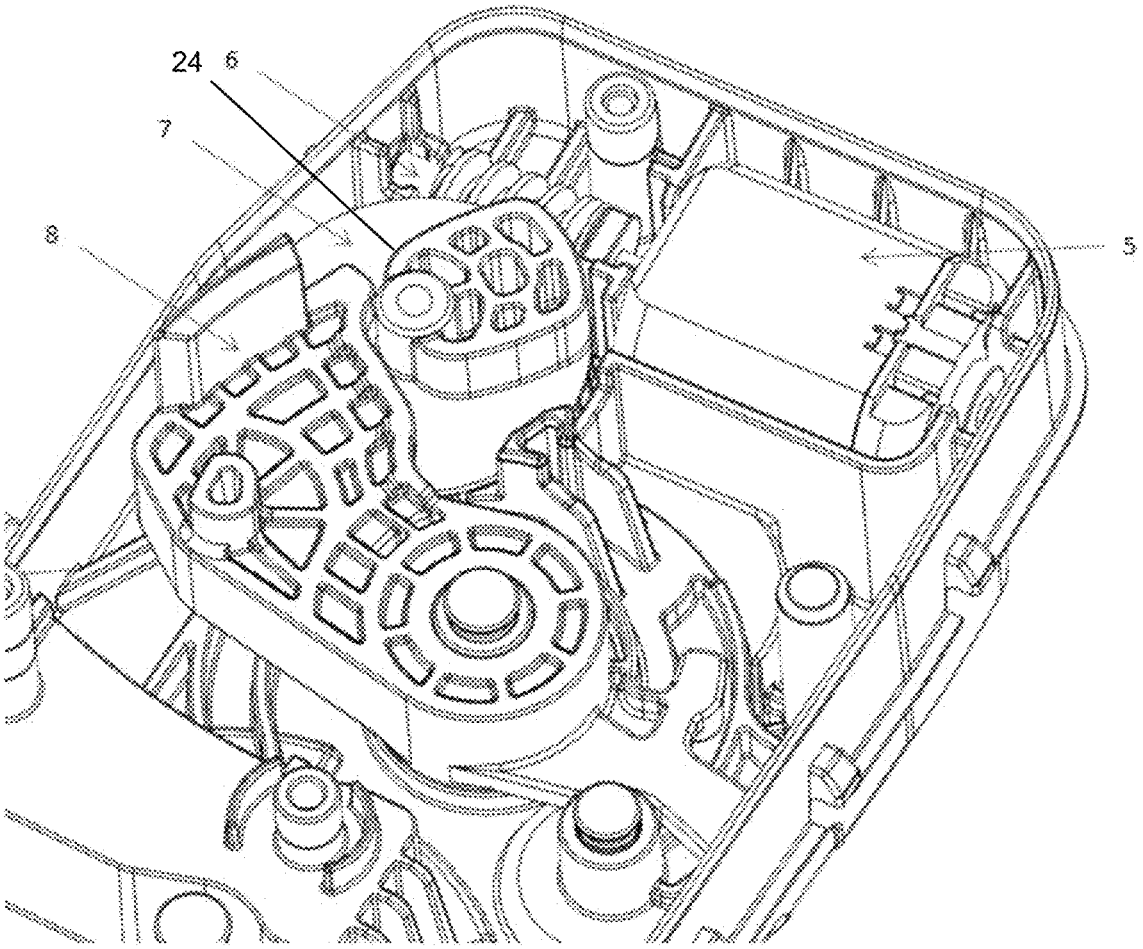
FIG. 3 is a perspective view of a portion of the electric/power release system for the latch assembly in accordance with the present disclosure.
Figure 11:
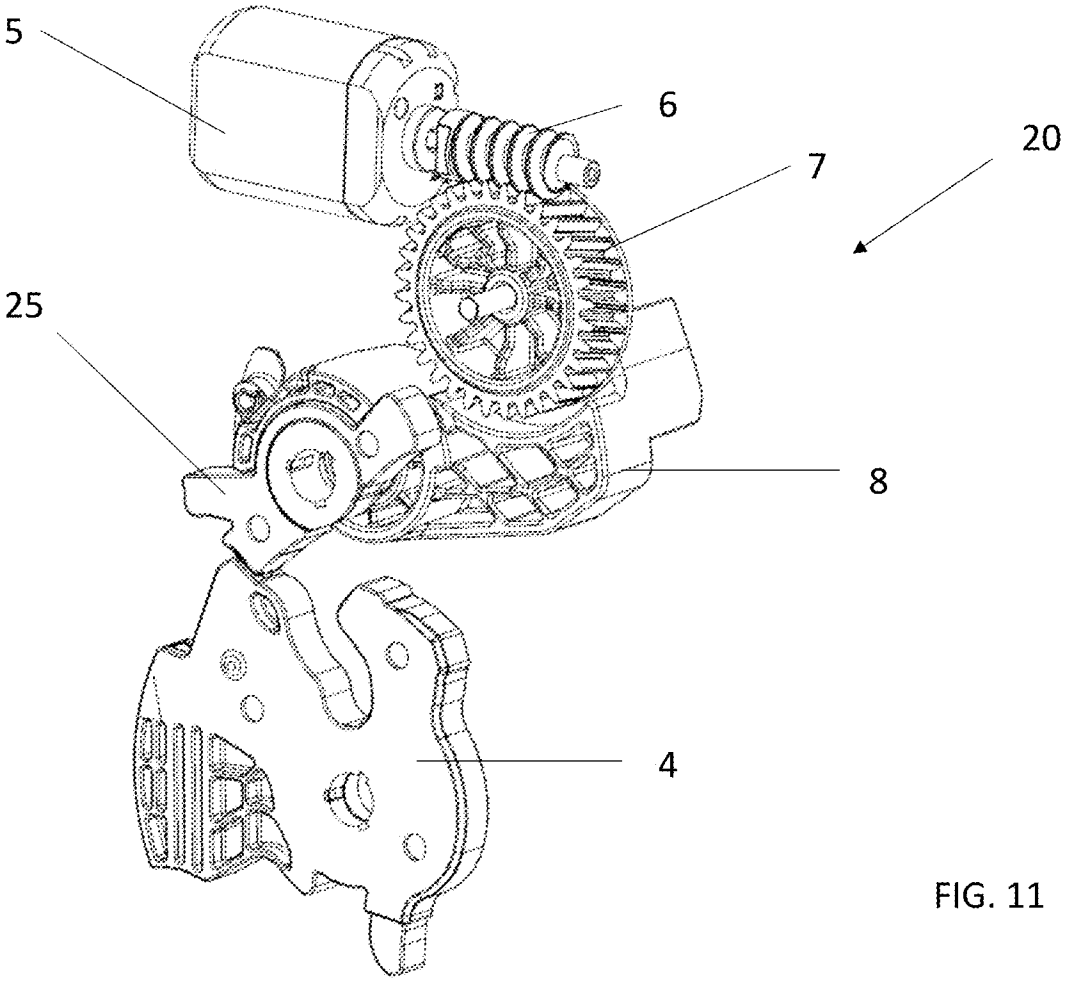
FIG. 11 illustrates portions of the latch assembly.

FIG. 3 shows the design of the electric/power release system for this latch. A motor 5 rotates a worm 6 which interfaces to a helical release gear or release gear 7 that releases the system. The release gear 7 has a cam profile 24 that interfaces with a pawl release lever or release lever 8, and the release lever 8 drives a pawl 25 (See FIG. 11) open, which allows for a claw 4 to release the striker. In other words, when the release lever or pawl release lever 8 is rotated counterclockwise (when viewed in FIG. 3), the latch will release and the door or vehicle door will open.

Figure 4:
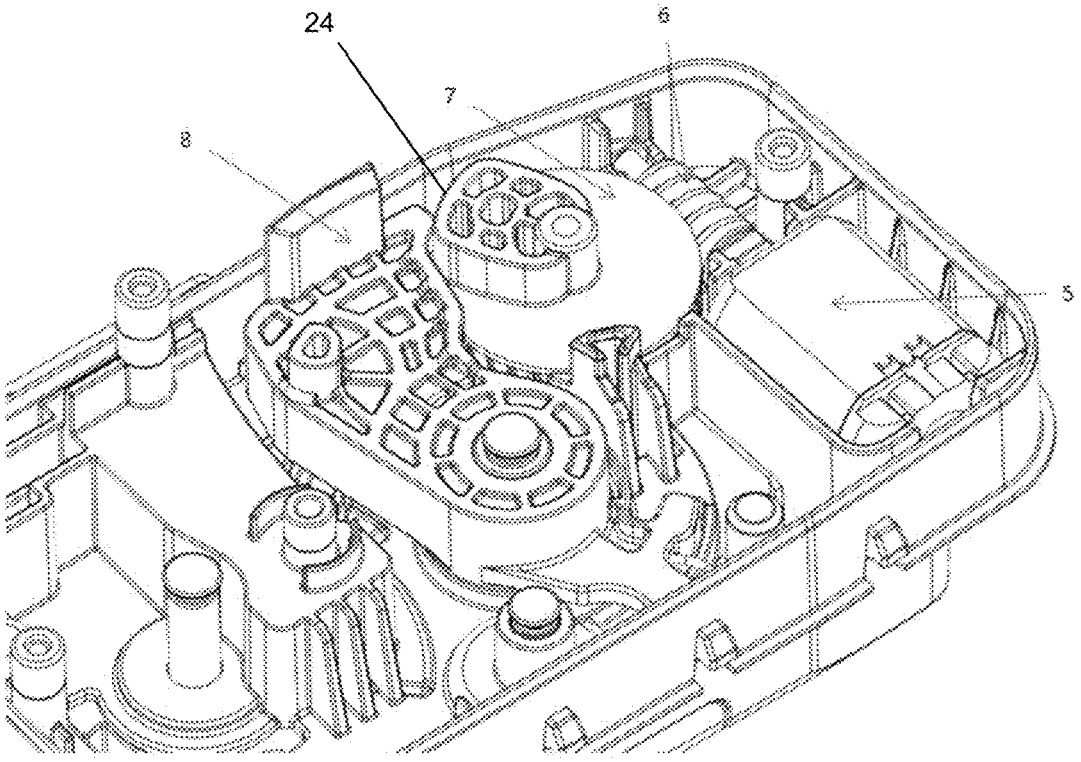
FIG. 4 illustrates a release lever and a release gear of the latch assembly in a released state in accordance with the present disclosure.

FIG. 4 shows the release lever or pawl release lever 8 and release gear 7 in a released state. The release gear 7 has rotated approximately 150 degrees in a counter clockwise direction from the view of FIG. 3, and the release lever or pawl release lever 8 has been rotated approximately 25 degrees in a counter clockwise direction from the view of FIG. 3. Although specific gear and lever rotations are provided here, it is understood that other gear and lever rotations greater or less than the aforementioned values are considered to be within the scope of the present application. At the full travel state, the cam or cam profile 24 of the release gear 7 and the release gear 7 are in a relationship to the release lever or pawl release lever 8 where the release lever or pawl release lever 8 is not capable of backdriving it.

Figure 5:
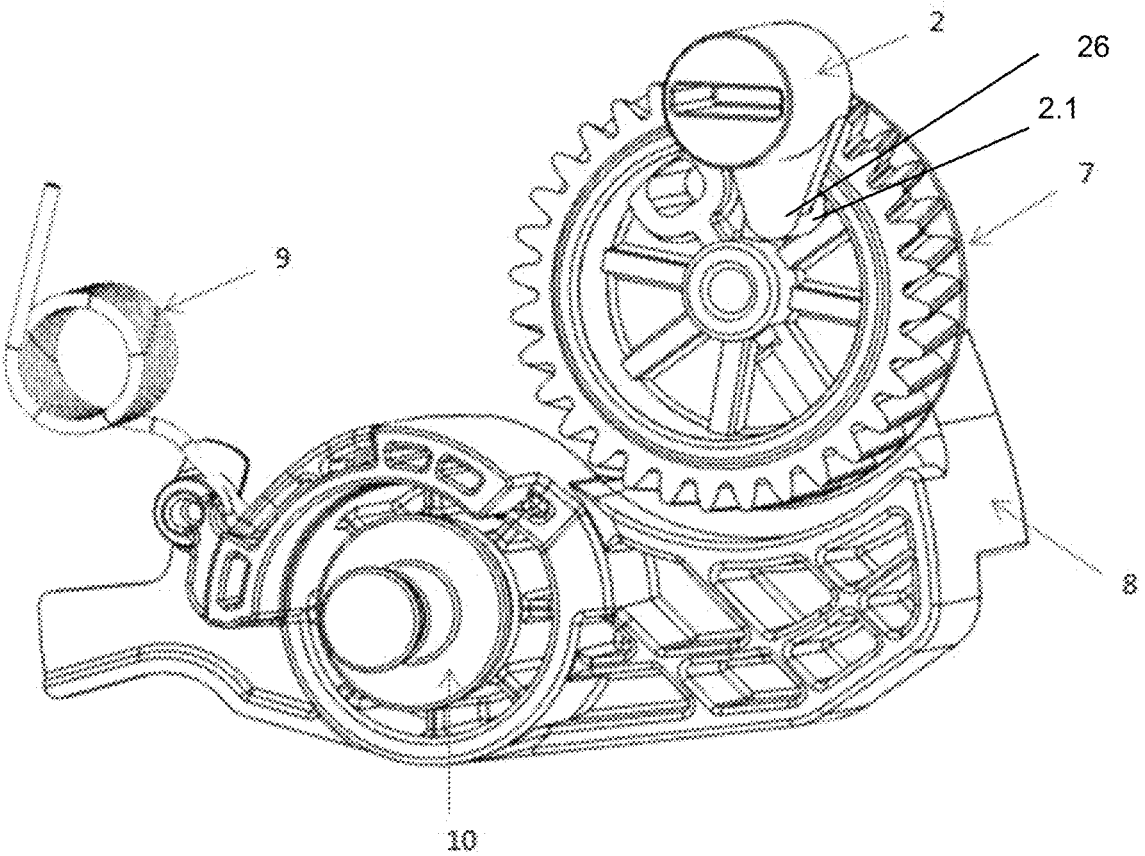
FIG. 5. illustrates the release gear of the latch assembly after the release gear has rotated, and the release lever has been rotated.

FIG. 5 shows the service override lever 2 and how it interfaces to the release gear 7. The service override lever 2 has a tab 26 with a boss 2.1 that can interact with the release gear 7. A pivot 10 and a return spring 9 for the release lever or pawl release lever 8 are also shown here. The return spring 9 biases the release lever or pawl release lever 8 counterclockwise about pivot 10 in this view.

Figure 6:
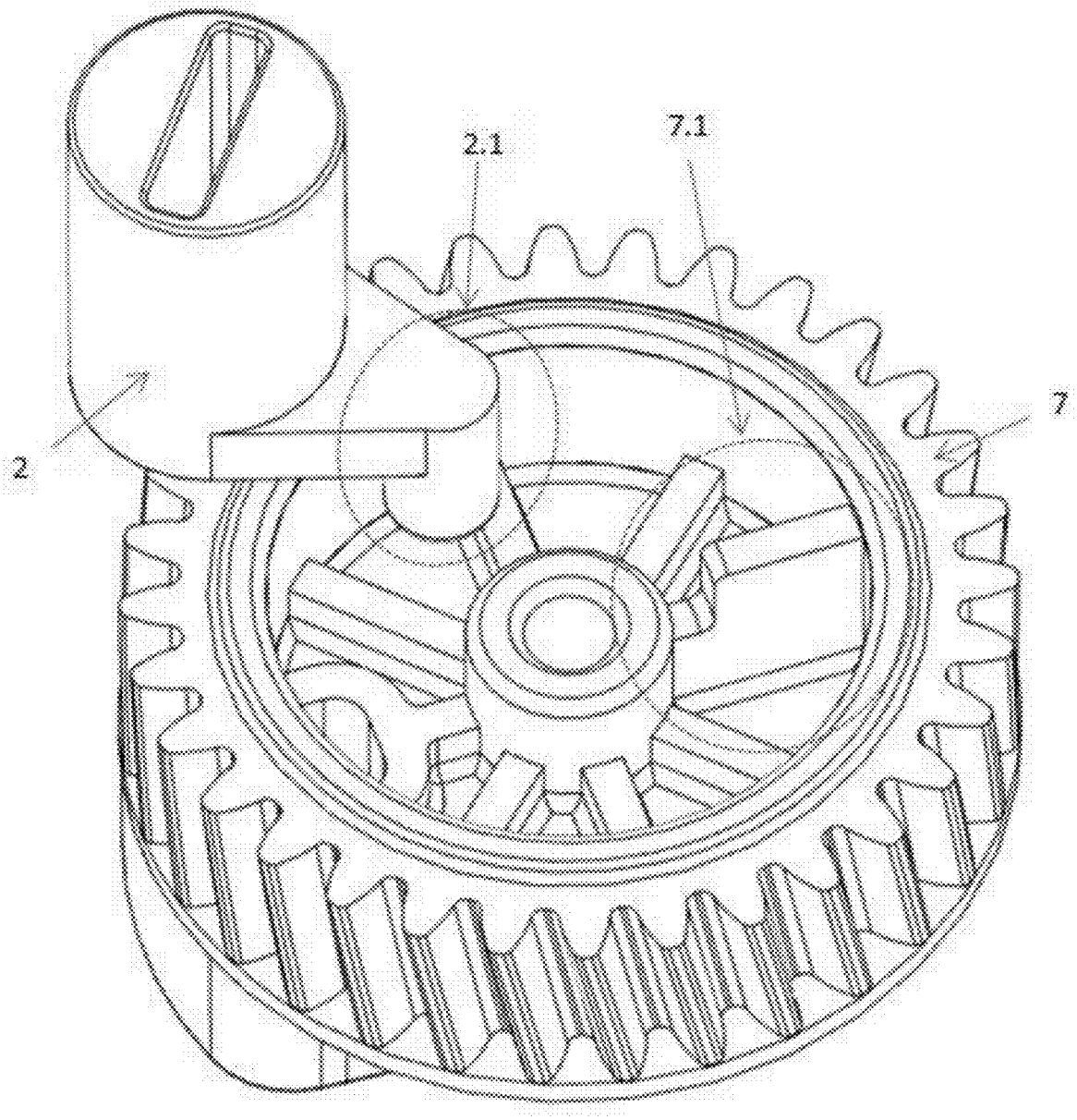
FIG. 6 illustrates the release gear in home position.

FIG. 6 shows the release gear 7 in a home position. A wall 7.1 of the release gear 7 that gets driven by the service override lever's boss 2.1 is also shown in this view.

FIGS. 7A and 7B illustrate the release gear 7 at a full travel position. Here the wall 7.1 of the release gear 7 that gets driven by the service override lever's boss 2.1 is now in contact, or close to being in contact with the service override lever's boss 2.1. If the motor 5 fails at this point, the latch would be stuck open, due to a hold open feature 7.3 of the gear cam or cam profile 24. The release lever or pawl release lever 8 is resting on the outer profile of the gear 7 which is creating a force normal to the gear's 7 pivot, therefore there is no backdriving torque being created.

FIGS. 8A and 8B illustrate the service override lever 2 being actuated or rotated in order to start backdriving the gear 7. The direction of the rotation of the service override lever 2 is illustrated by arrow 28. The boss 2.1 of the service override lever 2 beings driving the wall 7.1 of the gear 7 and rotates the gear partially counter clockwise in the view of FIG. 8A. This movement allows for the gear 7 to rotate enough in a clockwise direction in FIG. 8B so that it is no longer in a "locking" condition with the release lever 8. Area 7.5 in FIG. 8B shows that the cam profile 24 is no longer contacting the release lever or pawl release lever 8 , and now the release lever spring 9 will begin to move the release lever clockwise with respect to the view in FIG. 8B towards its home position.

Figure 9:
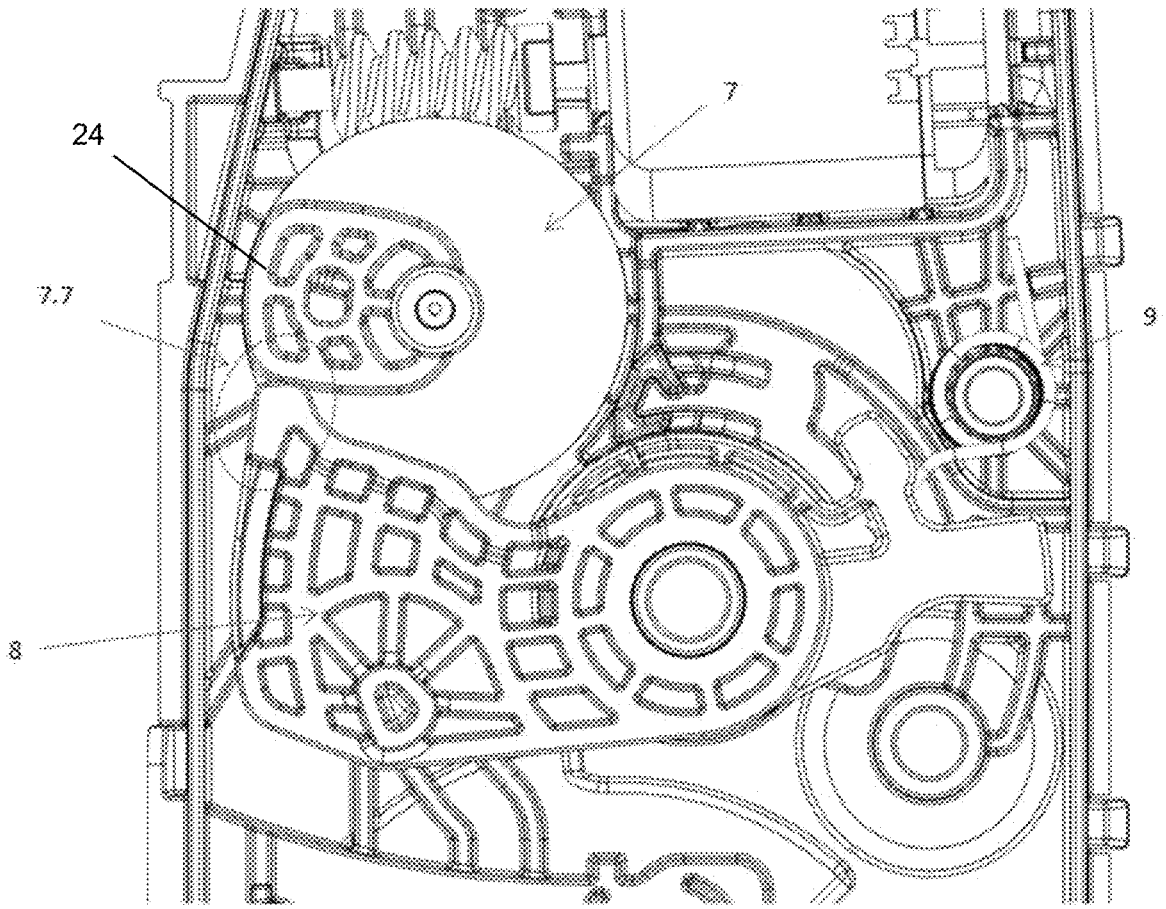
FIG. 9 illustrates the release lever contacting a gear cam of the latch assembly after the service override lever of the latch assembly has partially backdriven the release gear.

FIG. 9 shows the release lever or pawl release lever 8 contacting the gear cam 24 (area 7.7) after the service override lever 2 has partially backdriven the gear 7. Now that the gear 7 is no longing in the "locking" or "hold open" condition with the release lever or pawl release lever 8, the torque created by the release lever or pawl release lever 8 and its spring 9 will be able to backdrive the gear 7 to a home position.

Figure 10:
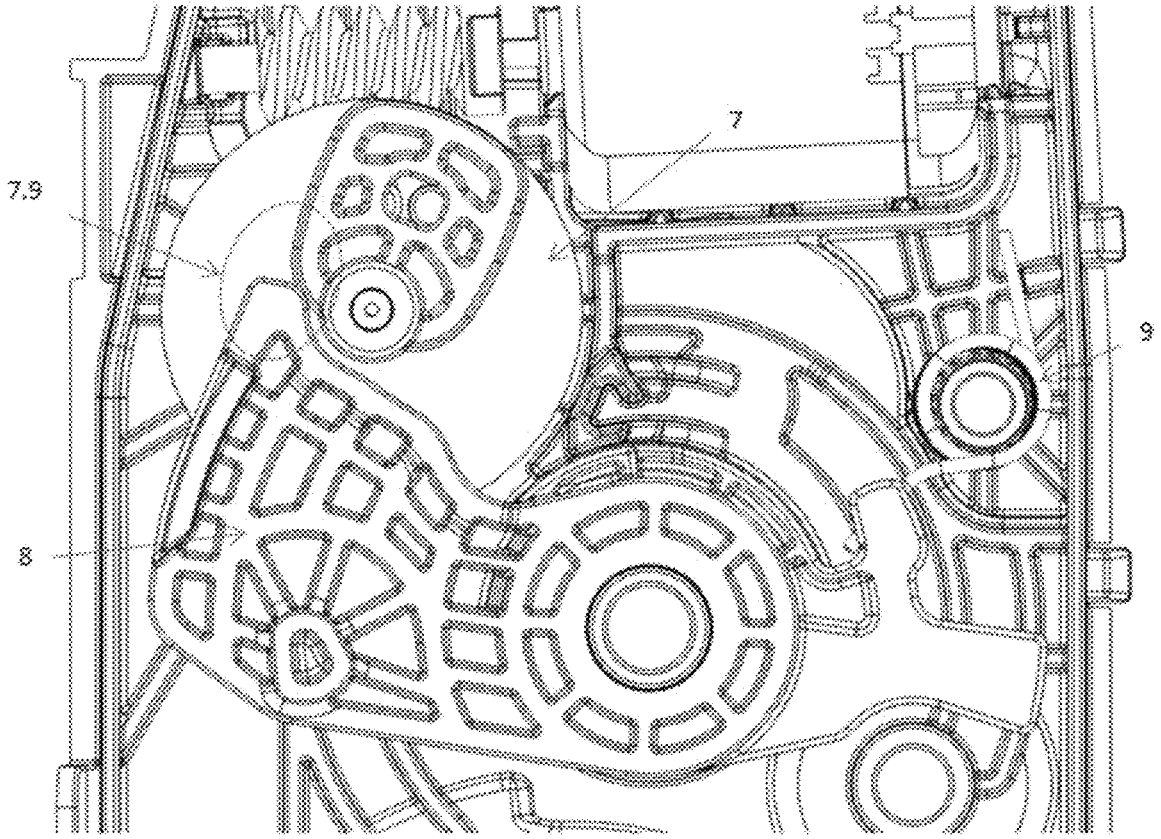
FIG. 10 illustrates the release gear backdriven to its home position by the release lever.

FIG. 10 shows the gear 7 backdriven to its home position by the release lever or pawl release lever 8. Now that the gear 7 is in a home position, the release lever is no longer holding the pawl open, and the system is now able to close, and open via a manual/emergency release cable(s). The occupant can now safely leave their vehicle temporarily or drive their vehicle to the dealership without their door being stuck open.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A power release latching system, comprising:

a housing;

a service override lever rotatably mounted to the housing, the service override lever being accessible from an exterior of the housing;

a motor for rotating a worm that interfaces to a release gear, the release gear having a cam profile on a first side of the release gear that interfaces with a pawl release lever of the latching system, the pawl release lever being operably coupled to a pawl that interfaces with a claw of the latching system, wherein rotation of the service override lever causes rotation of the release gear, and the service override lever has a boss that is configured to contact a wall of the release gear, the wall located on a second side of the release gear, the second side being opposite to the first side, the boss extending in a direction generally parallel to an axis of rotation of the release gear, the boss rotating about another axis generally parallel to the axis of rotation of the release gear.

2. The power release latching system as in claim 1, wherein the boss is spaced from the wall when the release gear is in a home position.

3. The power release latching system as in claim 1, wherein the cam profile contacts the pawl release lever when the release gear is in a full travel position.

4. The power release latching system as in claim 1, wherein the boss extends from a tab of the service override lever.

5. The power release latching system as in claim 3, wherein the boss is spaced from the wall when the release gear is in a home position.

6. The power release latching system as in claim 3, wherein the boss contacts the wall when the release gear is in a full travel position.

7. The power release latching system as in claim 1, further comprising a return spring for biasing the pawl release lever about a pivot.

8. The power release latching system as in claim 1, further comprising:

a frame configured to mount the latching system to a vehicle sheet metal.

9. The power release latching system as in claim 7, wherein the boss extends from a tab of the service override lever.

10. The power release latching system as in claim 9, wherein the boss is spaced from the wall when the release gear is in a home position and wherein the boss contacts the wall when the release gear is in a full travel position.

11. The power release latching system as in claim 10, wherein the cam profile contacts the pawl release lever when the release gear is in the full travel position.

12. The power release latching system as in claim 8, further comprising a return spring for biasing the pawl release lever about a pivot.

13. A power release latching system, comprising:

a housing;

a service override lever rotatably mounted to the housing, the service override lever being accessible from an exterior of the housing;

a motor for rotating a worm that interfaces to a release gear, the release gear having a cam profile on a first side of the release gear that interfaces with a pawl release lever of the latching system, the pawl release lever being operably coupled to a pawl that interfaces with a claw of the latching system, wherein rotation of the service override lever causes rotation of the release gear, and the service override lever has a boss that is configured to contact a wall of the release gear, the wall located on a second side of the release gear, the second side being opposite to the first side, the boss extending in a direction generally parallel to an axis of rotation of the release gear, wherein the boss contacts the wall when the release gear is in a full travel position.

14. The power release latching system as in claim 13, wherein the cam profile contacts the pawl release lever when the release gear is in the full travel position.

15. A method for manually releasing a power release latching system, comprising:

rotatably mounting a service override lever to a housing of the latching system, the service override lever being accessible from an exterior of the housing; and rotating a release gear of the latching system with the service override lever, the release gear having a cam profile on a first side of the release gear that interfaces with a pawl release lever of the latching system, the pawl release lever being operably coupled to a pawl that interfaces with a claw of the latching system, wherein the service override lever has a boss that is configured to contact a wall of the release gear, the wall located on a second side of the release gear, the second side being opposite to the first side, the boss extending in a direction generally parallel to an axis of rotation of the release gear, wherein the boss is spaced from the wall when the release gear is in a home position and wherein the boss contacts the wall when the release gear is in a full travel position.

* * * * *